United States Patent [19]

Ahearn

[11] 4,278,390

[45] Jul. 14, 1981

[54] GARBAGE CONTAINER TRUCK

[76] Inventor: Thomas M. Ahearn, 845 Burnett Rd., Chicopee, Mass. 01020

[21] Appl. No.: 72,437

[22] Filed: Sep. 4, 1979

[51] Int. Cl.[3] ..... B65F 3/02

[52] U.S. Cl. ..... 414/549; 414/555; 414/704; 414/728

[58] Field of Search ..... 414/546, 549, 555, 697, 414/704, 711, 712, 728, 408

[56] References Cited

U.S. PATENT DOCUMENTS

| | | | |
|---|---|---|---|
| 2,911,118 | 11/1959 | Tapp | 414/549 |
| 3,155,251 | 11/1964 | Williamson | 414/712 X |
| 3,820,673 | 6/1974 | McVaugh | 414/546 |
| 3,952,890 | 4/1976 | Armstrong | 414/712 X |
| 4,030,626 | 6/1977 | Durham | 414/704 |
| 4,091,944 | 5/1978 | Gollnick | 414/408 X |
| 4,167,366 | 9/1979 | De Vivo | 414/697 |

*Primary Examiner*—James L. Rowland

*Attorney, Agent, or Firm*—Weingarten, Maxham & Schurgin

[57] ABSTRACT

A vehicle for transporting garbage containers or the like fron one place to another. The vehicle includes a mast which is disposed on a flat bed to the rear of a truck cab and which is capable of traveling longitudinally along the length of the truck bed from one end adjacent the cab to the other end. Extending from the mast is a boom and pivotally secured to the distal end thereof is a fork lift assembly. The boom may be raised or lowered hydraulically while the attitude of the fork lift assembly may also be adjusted hydraulically. A parallel motion mechanism links the fork lift assembly to the mast and maintains the fork lift assembly at a pre-adjusted attitude regardless of the elevation of the boom. Hydraulically-operated clamping arms are provided on the fork lift assembly to clamp a lid down on a container during lifting of the container onto the truck and during transportation of the container to another location.

19 Claims, 10 Drawing Figures

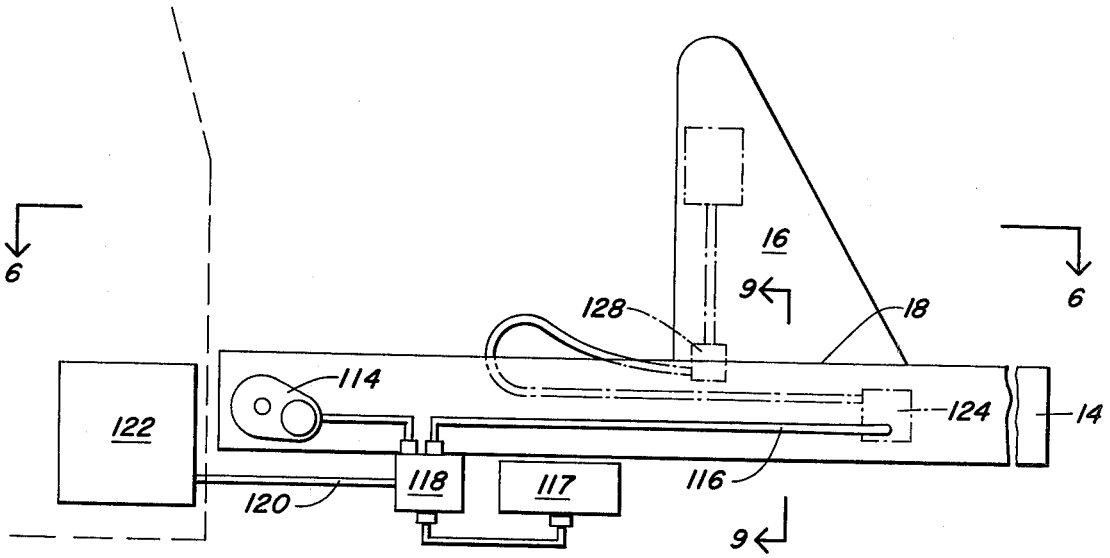
Fig. 7
Fig. 6
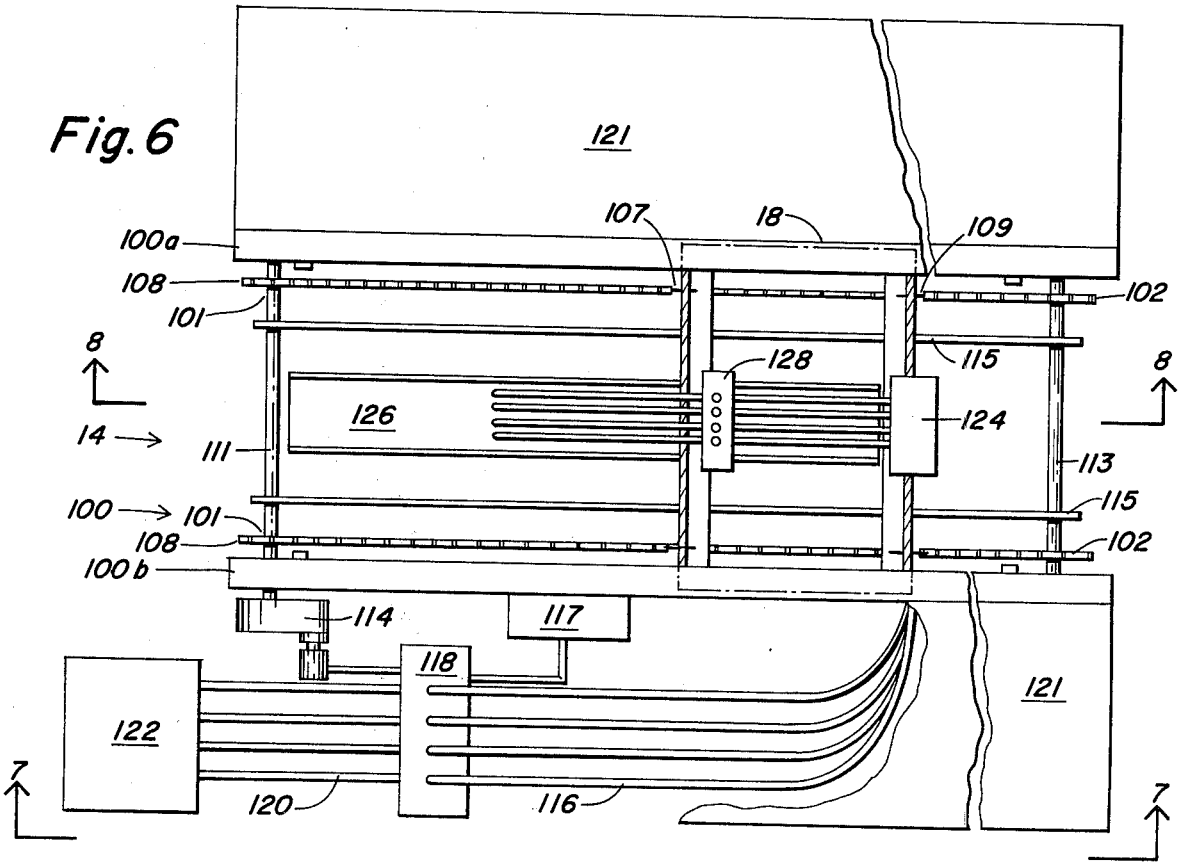

GARBAGE CONTAINER TRUCK

FIELD OF THE INVENTION

The present invention relates generally to container handling and more particularly concerns a vehicle for lifting large garbage containers onto a vehicular bed by means of a self-leveling fork lift assembly which is longitudinally movable along the bed, and for transporting such containers from one location to another.

DISCUSSION OF THE PRIOR ART

Difficulties are often encountered in lifting large containers or transporting them from one place to another, especially those containers filled with materials or the like, because of their weight and bulk. In particular, it is often necessary to lift garbage containers into a truck and transport them to another location or to a location where they are to be emptied. During such an operation, the container must be maintained at a desired attitude and it must be prevented from falling from the truck, and any cover thereof must be secured to prevent the premature release of garbage.

Many vehicles are available in the prior art for transporting various types of containers, including garbage containers. One such type has a fork lift on the front, rear or side thereof and is adapted only for lifting of containers from one position to another and either for loading the containers onto other vehicles or for transporting them over very short distances. These vehicles generally are not capable of long trips and they are designed only to lift containers resting on pallets or containers having a provision for insertion of fork arms beneath them. Examples of such vehicles are found in U.S. Pat. Nos. 2,127,938; 2,621,811; 2,366,378; 3,155,251; 3,410,433; 3,799,379; 3,967,744; and 4,147,263.

Other types of prior art container-handling vehicles do have provision for storing the container on a truck bed or the like for transportation thereof over long distances. However, some of these vehicles have a fork lift which requires that the container be elevated off the ground or that a pallet be used so that the fork arms can be inserted beneath them, such as in U.S. Pat. Nos. 2,980,269; 3,235,105; 3,259,257; 3,300,071; and 3,586,183. Others of these vehicles require the use of a pair of arms having hooks and/or wires which permit the container or object to be raised upwardly and slong over the end of the truck bed between the arms, such as in U.S. Pat. Nos. 1,052,096 and 2,911,118.

Many vehicles have been devised primarily for the lifting, transportation and dumping of containers suitable for holding garbage or like materials. Examples of such vehicles are found in U.S. Pat. Nos. 2,369,722; 2,978,122; Re 23,546; 2,702,142; 2,437,806; and 2,305,148. In U.S. Pat. Nos. 2,702,142 and 2,369,722, the container is tilted into the truck bed over a rear edge thereof by means of wires, while U.S. Pat. Nos. Re 23,456, 2,437,806 and 2,978,122 use either chains, wires or a fork placed under the container to lift the container onto the truck bed in a manner similar to that described in other prior art devices.

None of the vehicles described in the above-referenced prior art is suitable for use with containers having sleeves on the sides thereof adapted for the insertion of fork arms therethrough to lift and transport them. One vehicle that does have fork arms to lift such containers is shown in U.S. Pat. No. 3,202,305, however, this vehicle does not have a bed or other means for storing the container for transportation over long distances. This vehicle is only adapted for the emptying of garbage containers.

None of the above-referenced patents disclose any means for securing the lid of the container during transportation thereof. Furthermore, none of the above-cited prior art vehicles has the capability of adjusting the attitude of the lifting device to place the container at any desired angle and to automatically maintain that angle without further adjustment during lifting and transportation of the container.

Other types of material-handling vehicles have adjustable carriers that are maintainable in a desired attitude. Examples of such vehicles are found in U.S. Pat. Nos. 2,887,236 and 3,713,557. However, neither of these devices is suited for lifting or transporting large containers.

SUMMARY OF THE INVENTION

Broadly speaking, this invention concerns a container-handling vehicle adapted for the lifting and transportation over long distances of containers, especially garbage containers. The vehicle includes a horizontal bed and a cab. A vertical mast is disposed on the bed, and extending from the mast away from the cab and towards the rear of the vehicle is a hydraulically actuated boom. Pivotally secured to the distal end of the boom is a fork lift assembly. The boom is adapted to raise and lower the fork lift assembly and the fork lift assembly is self-leveling and maintains the container at any desired attitude with respect to the vertical at all times during lifting of the container. A chain drive on the truck bed is adapted to move the boom longitudinally therealong from one end adjacent the cab to the other end. Hydraulically-actuable clamp arms disposed on the fork lift assembly are adapted to hold down the hatch cover of the container during transportation thereof.

The fork lift assembly includes two spaced fork arms extending horizontally outwardly from a substantially vertical support member. The fork arms are particularly suited for insertion into sleeves disposed on either side of a garbage container. The boom has an obtuse bend so that it may be attached to the fork lift assembly near the center of gravity of the container while still permitting the fork lift assembly to be raised or lowered to any necessary level.

In operation, the mast is first moved adjacent the rear end of the truck bed. The boom is then lowered until the fork arms are parallel to the container sleeves, and the mast is moved further back until the fork arms are inserted into the sleeves. The boom is raised, lifting the container over the rear end of the truck bed as the mast is moved forwardly toward the cab. Next, the boom is lowered until the container rests on the truck bed. The clamp arms are then actuated to hold down the latches. The process may be reversed to unload the container.

BRIEF DESCRIPTION OF THE DRAWING

The objects, advantages and features of this invention will be more clearly appreciated from the following detailed description when taken in conjunction with the accompanying drawing in which:

FIG. 6 is a top view of the bed of the vehicle of this invention showing details thereof;

FIG. 7 is a side view of the bed of the vehicle of this invention;

DETAILED DESCRIPTION OF THE PREFERRED EMBODIMENTS

Figure 1:
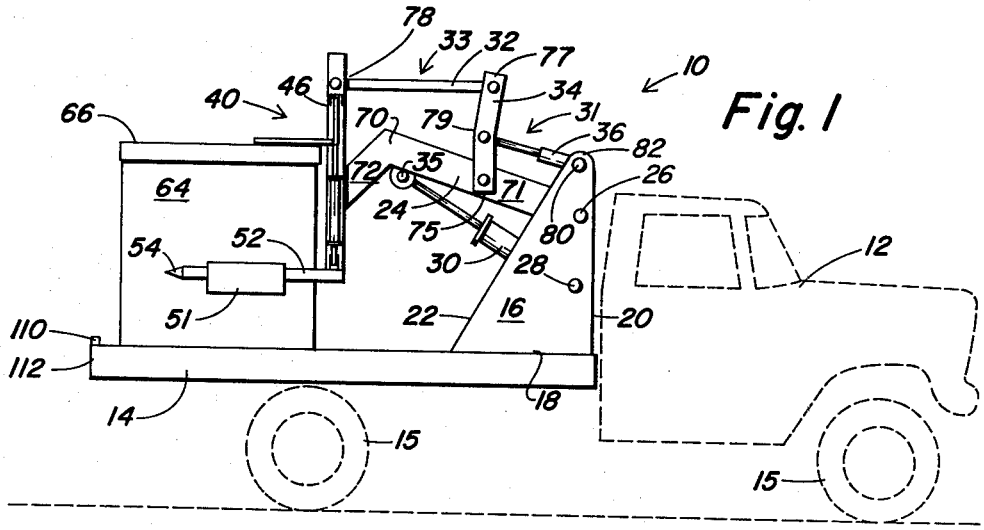
FIG. 1 is a side view of the vehicle of this invention in one operating position.

With reference now to the drawing and more particularly to FIGS. 1, 2, 3 and 4 thereof, there is illustrated an embodiment exemplifying this invention. A vehicle 10 is shown having a cab 12 attached to a rearwardly disposed horizontal bed 14 which is supported on wheels 15. Bed 14 has a raised ledge 110 disposed on end 112 thereof.

Disposed on bed 14 is mast 16, which in the embodiment of FIGS. 1–4 has a substantially right triangular shape. One leg 18 of mast 16 is slidably secured to bed 14 in a manner to be described more fully in a later paragraph, while the other leg 20 extends upwardly generally perpendicularly on bed 14. Extending from hypotenuse 22 of mast 16 is boom 24 which is pivotally secured to mast 16 adjacent leg 20 by bolts 26 or by any other known means. Pivotally secured to the other end of boom 24 by cross-bar 42 is fork lift assembly 40. Fork lift assembly 40 includes two vertical arms 44 and 46 which are spaced from one another and held together by cross-bar 42. Secured to a bottom end of arms 44 and 46 is another cross-bar 48 which is disposed parallel to bar 42 and which extends outwardly the same distance beyond each arm 44 and 46. Disposed on each outwardly extending end of cross-bar 48 and projecting away from bed 14 in a direction substantially parallel thereto are fork arms 50 and 52. Fork arms 50 and 52 preferably are parallel and have substantially pointed ends 54. Cross-bar 48 preferably has a length approximately equal to the width of a garbage container 64, and thus fork arms 50 and 52 are spaced so that they may be inserted into respective horizontal sleeves 51 on either side of container 64. Sleeves 51 permit container 64 to be lifted and lowered by arms 50 and 52 so long as arms 50 and 52 are maintained in an essentially horizontal position. Sleeves 51 may be located at any height along the sides of container 64 so long as each pair of sleeves 51 is situated at the same height above the bottom of container 64.

Figure 2:
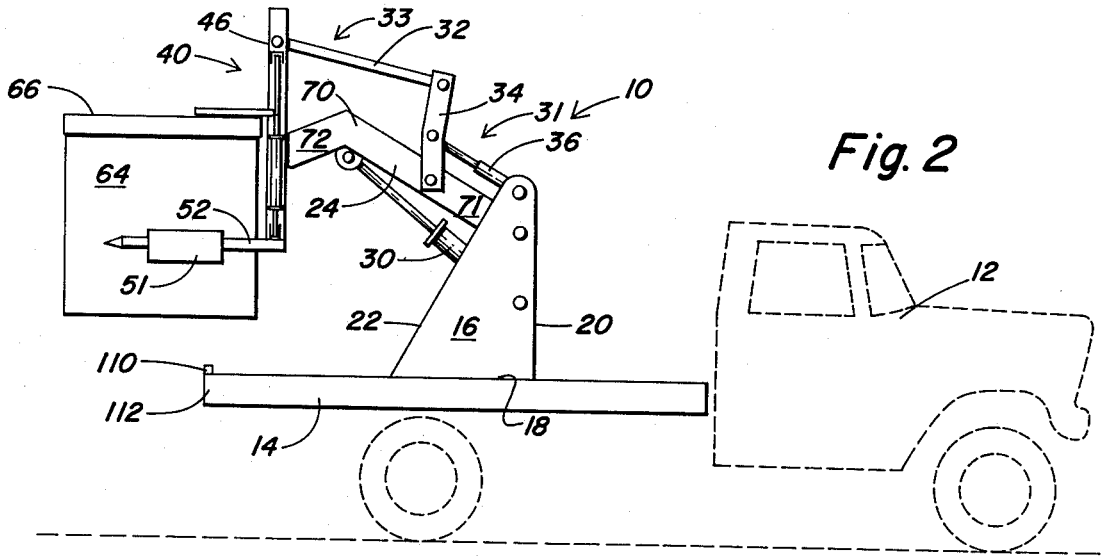
FIG. 2 is a side view of the vehicle of this invention in another operating position.
Figure 3:
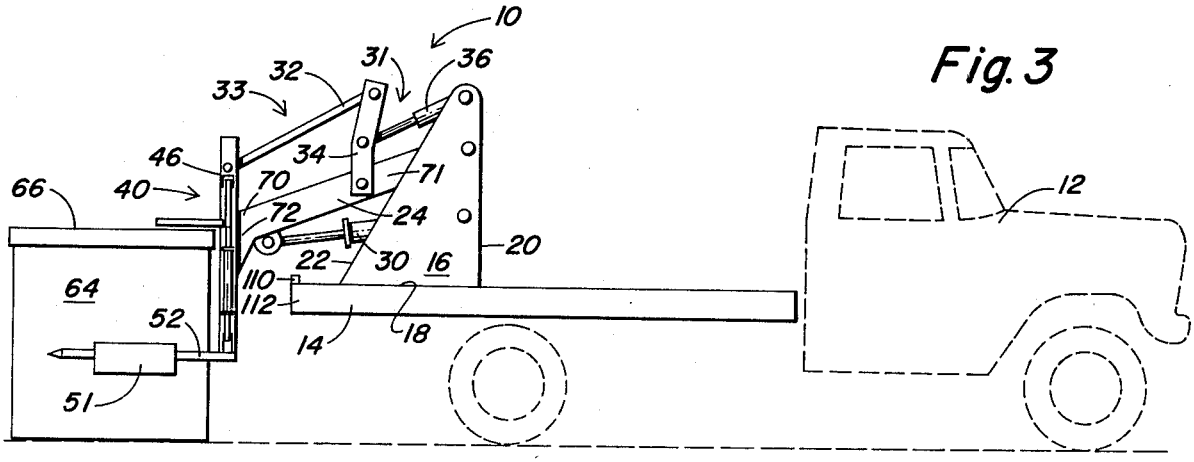
FIG. 3 is a side view of the vehicle of this invention in a third operating position.

Boom 24 and thus fork lift assembly 40 are raised and lowered by means of hydraulic cylinder 30 which also serves as the support for boom 24. Cylinder 30 is pivotally secured to boom 24 by a bolt or other known means at point 35 and is pivotally secured to mast 16 adjacent leg 20 by bolt 28 or other known means. Hydraulic cylinder 30 preferably is capable of lowering fork arms 50 and 52 to a point just above ground level or just above the bottom of wheels 15 as shown in FIG. 3, and of raising fork arms 50 and 52 to a point well above bed 14, as shown in FIG. 2. This lifting range is required so that a container 64 may be lifted from a resting position on the ground to a point above bed 14 and inside end 112 so that it may be placed on bed 14.

Cross-bar 42 is preferably located on fork lift assembly 40 at a point just above fork arms 50 and 52 but below the level of a hatch 66 on top of container 64. This positioning of cross-bar 42 is desirable, since it places the end of boom 24 near or slightly above the center of gravity of container 64, and also at a point just above where fork arms 50 and 52 are secured to respective arms 44 and 46, thereby minimizing the torque produced by container 64 on ends 54 of fork arms 50 and 52 and the torque created on the lower end of arms 44 and 46 about cross-bar 42. Boom 24 has two sections 71 and 72 joined at an obtuse angle 70. Angle 70 is preferably of a size such that when fork arms 50 and 52 are in their lowest operating position, as shown in FIG. 3, end 72 of boom 24 is substantially parallel to vertical arms 44 and 46. In this manner, no portion of end 72 projects between arms 44 and 46 to touch container 64 and to interfere with the lifting and loading thereof. This configuration of boom 24 permits boom 24 to be affixed to fork lift assembly 40 as indicated while also permitting hydraulic cylinder 30 to be mounted on mast 16 and still form an angle with respect to boom 24 sufficiently great to allow cylinder 30 to raise or lower boom 24 under all known load conditions, from the lowest operating position as shown in FIG. 3 to the highest operating position as shown in FIG. 2.

Fork lift assembly 40 is linked to mast 16 by means of inner mechanical linkage 31 and outer parallel motion mechanism 33. Inner mechanical linkage 31 includes mast 16, hydraulic cylinder 36, rocker arm 34 and a portion of boom 24. Outer parallel motion mechanism 33 includes rocker arm 34, vertical arms 44 and 46, link 32 and the distal end of boom 24, including end 72 and angle 70. Cylinder 36 is pivotally secured to mast 16 near apex 82 by bolt 80 or other known means. The other end of cylinder 36 is pivotally attached to rocker arm 34, preferably near the center thereof, by bolt 79 or other known means. Cylinder 36 is used to adjust the attitude of rocker arm 34 and thus of arms 44 and 46 and all of fork lift assembly 40. Rocker arm 34 is connected at the lower end 75 thereof to boom 24, preferably at a point intermediate angle 70 and bolt 26. Rocker arm 34 is adapted to be pivoted about end 75, and rocker arm 34 preferably may have a slight bed about bolt 79, as shown in FIGS. 1–3. Secured to upper end 77 of rocker arm 34 is a link 32 which extends therefrom to cross-bar 78 on fork lift assembly 40. Link 32 is pivotally attached at either end thereof.

The distance from cross-bar 42 to cross-bar 78 is equal to the distance from end 75 to end 77 of rocker arm 34, and the distance from end 75 of rocker member 34 to arms 44 and 46 is equal to the length of link 32. Thus, the opposed parts of outer parallel motion mechanism 33, link 32 and boom 24 and rocker arm 34 and arms 44 and 46 are maintained in a fixed predetermined relationship to each other and they form a parallelogram linkage. With respect to inner mechanical linkage 31, it will be noted that the distance from bolt 26 to bolt 80 is equal to the distance from end 75 of rocker member 34 to bolt 79, so that opposed members, boom 24 and cylinder 30, and rocker arm 34 and leg 20 are maintained in a predetermined relationship to each other.

Since the position of leg 20 is permanently fixed with respect to the horizontal and to bed 14, so also is the attitude of rocker arm 34 and fork lift assembly 40 for a given setting of cylinder 36, regardless of the attitude of boom 24. Conversely, any change in attitude of rocker arm 34 caused by adjustments to cylinder 36 is automatically translated to fork lift assembly 40. When cylinder 36 is extended, end 77 of rocker arm 34 is pivoted about end 75 towards fork lift assembly 40 over a certain angle, and the upper end of fork lift assembly 40 is pivoted about cross-bar 42 away from mast 16 over an equivalent sized angle. When cylinder 36 is retracted, end 77 of rocker arm 34 is pivoted about end 75 away from fork lift assembly 40 over a certain angle, and the upper end of fork lift assembly 40 is pivoted about cross-bar 42 away from mast 16 an equivalent size angle. Because the relationship of the opposed members of both outer parallel motion mechanism 33 and inner mechanical linkage 31 are fixed with respect to one another for any setting of cylinder 36, these mechanisms serve as a self-leveling means. This feature insures that once fork arms 50 and 52 are adjusted to form an angle with respect to bed 14, that angle is maintained at all times, no matter what the angle of elevation of boom 24 may be and no matter what the elevation of fork lift member 40 may be. This feature makes it necessary to adjust cylinder 36 only once prior to the insertion of fork arms 50 and 52 through sleeves 51.

It should be noted that the structure of the outer parallel motion mechanism 33 and the inner mechanical linkage 31, as described, facilitates adjustment of the attitude of fork lift assembly 40. The long moment arm represented by the distance from cross-bar 42 to cross-bar 78 where torque is applied by link 32 allows for precise adjustment of the attitude of fork lift assembly 40. The utilization of a rocker member 34 permits such precision without the necessity of extending mast 16 to a much greater height. Furthermore, the positioning of cylinder 36 so that torque is applied to the middle of rocker member 34 to pivot it about end 75 permits the use of a hydraulic cylinder having a shorter reach than would be necessary if the cylinder were attached to end 77 of rocker member 34.

Figure 4:
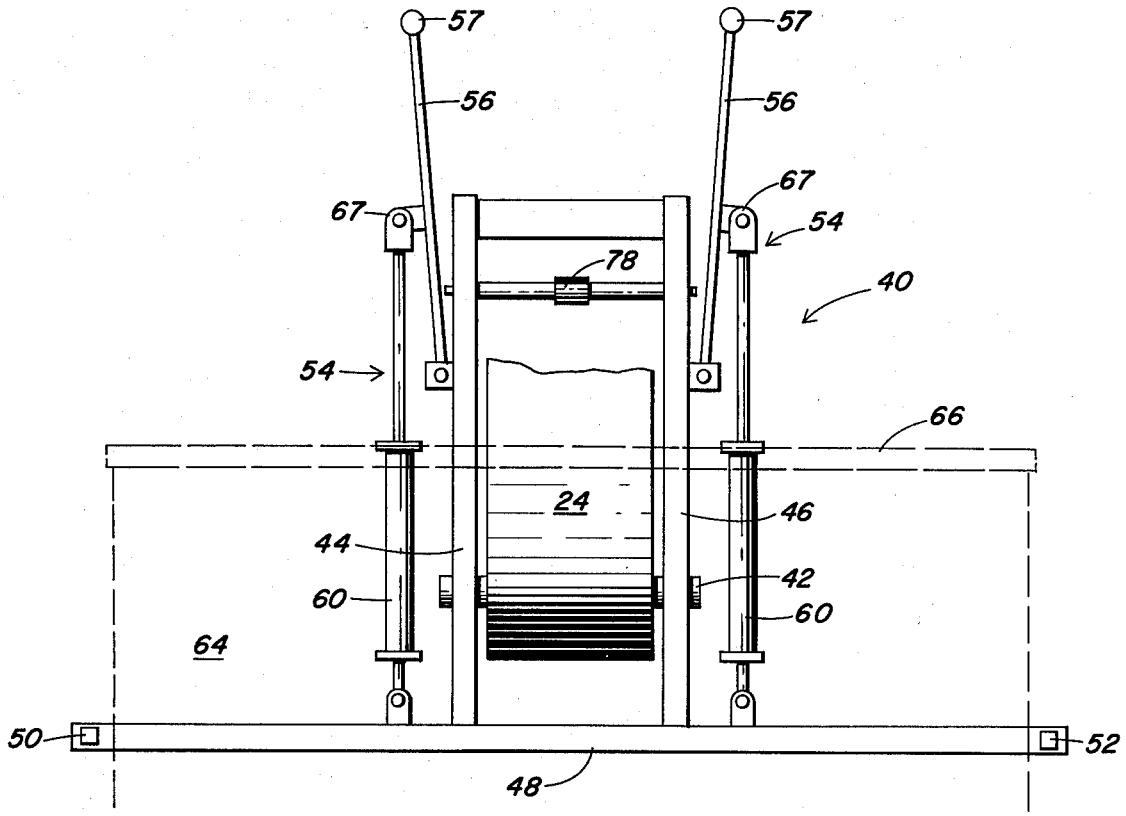
FIG. 4 is a rear view of the fork lift mechanism of this invention.
Figure 5:
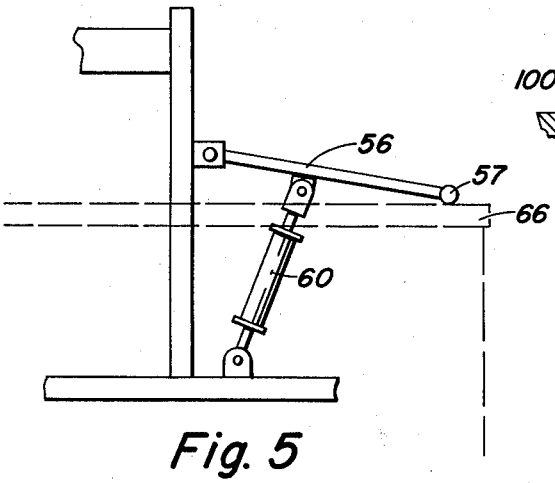
FIG. 5 is a view of a hatch clamp of this invention.

With reference now to FIGS. 4 and 5, the hatch cover clamps will be described. Clamps 54 are each mounted on an outwardly facing side of each arm 44 and 46, and each hatch cover clamp 54 includes an arm 56 which is pivotally secured to a respective arm 44 and 46. A finger 57 disposed on a distal end of each arm 56 projects in a direction substantially parallel to fork arms 50 and 52 to overlie the top of container 64 being supported by fork lift assembly 40. Pivotally secured at one end thereof to cross-bar 48 directly below arm 46 and closely adjacent arms 44 and 46 are hydraulic cylinders 60. Each cylinder 60 extends upwardly and the other end 67 thereof is pivotally secured to arm 56, generally at the center thereof. When each cylinder 60 is extended, arm 56 is in a non-operational position in which it projects generally upwardly away from container 64. When each cylinder 60 is actuated, end 67 is retracted, drawing associated arm 56 downwardly until finger 57 and the distal end of arm 56 are in engagement with the hatch cover 66 of container 64. Cylinders 60 remain in an actuated condition as long as necessary and as long as container 64 is being transported. Once the hatch cover 66 is to be released, cylinders 60 are again extended, pivoting arms 56 about their connections on arms 44 and 46 until arms 56 are again in an upwardly extending, non-operational position.

Figure 8:
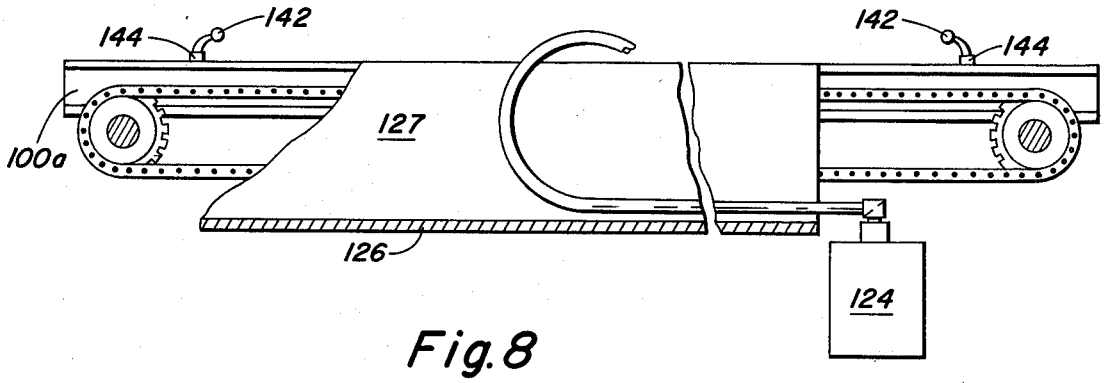
FIG. 8 is a partial cross-sectional view of the bed of the vehicle of this invention taken along line 8—8 of FIG. 6.

Referring now to FIGS. 6–8, mast 16 rests on a set of tracks 100 on bed 14 and is movable in a longitudinal direction therealong from one end of bed 14 adjacent cab 12 to the other end 112. In a preferred embodiment, mast 16 is connected to a pair of chains 108 passing through gears 101 and 102 on respective axles 111 and 113 mounted on tracks 100. Chains 108 are driven by motor 114 attached to axle 111 adjacent cab 12. Support beams 115 are mounted closely adjacent each chain 108 and extend along the length of bed 14. Chains 108 are thus each located between a support beam 115 and an associated track 100.

Hydraulic hoses 116 extend from connection means 118 rearwardly along one side of bed 14 underneath protective plate 121 and between tracks 100 and the outer edge of bed 14. Connection means 118 is hydraulically linked to compressor 117. Hoses 116 are connected to controls 122 in cab 12 by lines 120. Hoses 116 pass through track **100*b* below leg 18 at about the center of track 100*b* and extend to support 124 intermediate support beams 115**.

A pan 126 having sides 127 extends from support 124 to cab 12 at a distance below bed 14 sufficient to permit hoses 116 to pass between the bottom of mast 16 and pan 126. Hoses 116 go from support 124, along pan 126 towards cab 12 a certain distance, at which point hoses 116 are folded back onto themselves and extend therefrom to connection points 128 on mast 16. At connection points 128, each hose 116 is attached hydraulically to a respective one of cylinders 30, 36 and 60 which it is adapted to control. Hoses 116 are sufficiently long to permit mast 16 to travel to a point adjacent cab 12 or to end 112 of bed 14. As mast 16 travels toward cab 12, hoses 116 are unwrapped and lie down along the bottom of pan 126 until they are nearly fully extended as mast 16 reaches the end of tracks 100 adjacent cab 12. As mast 16 travels toward end 112, hoses 116 are lifted off bed 126 and fold over onto themselves until they are nearly fully extended toward end 112 as mast 16 reaches that end of tracks 100.

Figure 9:
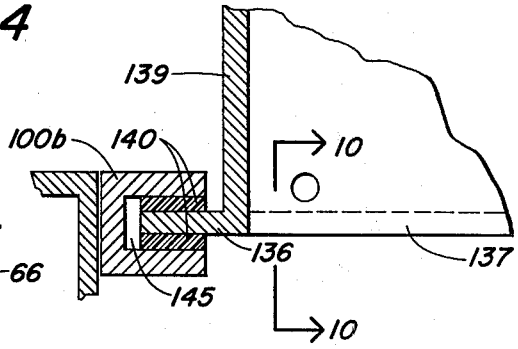
FIG. 9 is a partial cross-sectional view taken along the line 9—9 of FIG. 7.
Figure 10:
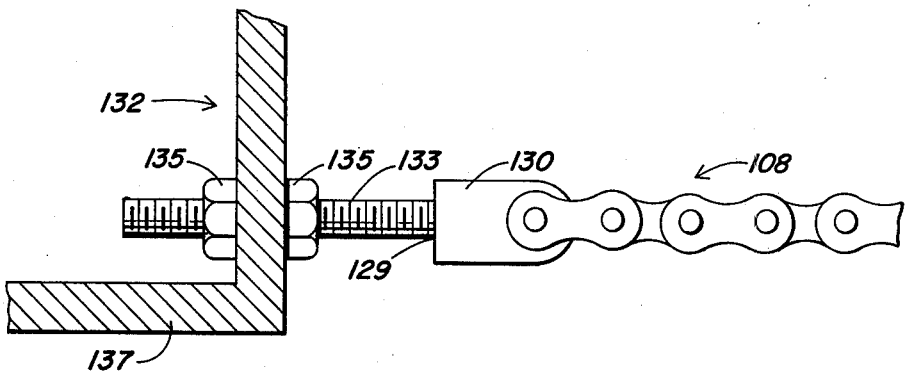
FIG. 10 is a partial cross-sectional view taken along the line 10—10 of FIG. 9.

With reference to FIGS. 6, 9 and 10, the manner of attachment of mast 16 to chains 108 and to tracks 100 will now be described. Mast 16 has roughly the same latitudinal width as the distance between rails **100*a* and 100*b* of tracks 100, and mast 16 is generally centrally disposed on bed 14. Chains 108 are located inside of rails 100*a* and 100*b*, but are spaced from one another a predetermined distance. Two chains 108 are preferred, to promote uniform movement of mast 16 on tracks 100. To this end, each chain 108 should be the same distance from its associated outside rail 100*a* or 100*b* as is the other chain 108**.

Each end of each chain 108 is secured to mast 16. One end 107 is secured to leg 18 at an end thereof facing cab 12, while the other end 109 is secured to leg 18 at an end thereof facing end 112 of bed 14. Chains 108 thus extend from end 109, to gears 102, back along bed 14, over gears 101 and then to end 107.

Ends 107 and 109 of each chain 108 both terminate in an end link 130 which has threaded hole 129 capable of receiving a threaded bolt 133. Bolt 133 extends from link 130 through a hole in angle 132 where bolt 133 is secured by nuts 135. One angle 132 extends the entire width of mast 16 from rail **100*a* to rail 100*b*, and there is an angle 132 on each end of leg 18. Each angle 132 has a portion 137 which extends toward mast 16 and away from link 130 and which is adapted to accommodate connections to respective ends of leg 18. Bolts 133 and nuts 135 may be used for adjusting the tension on chains 108 to make mast 16 sufficiently responsive to movement of chains 108 and for making the tension on one chain 108 equal to that on the other chain 108. If the tension is not the same, the pull on each side of mast 16 by chains 108 will not be equal and mast 16 could become skewed with respect to bed 14**.

Disposed perpendicularly of angle 132 and extending substantially parallel to leg 18 and along the length thereof are a pair of angles 139. An angle 139 is disposed on either side of mast 16 and is associated with one of rails 100*a* and 100*b* of tracks 100. Each angle 130 has a lip 136 that projects outwardly from mast 16 and into a groove 145 formed in an associated rail 100*a* or 100*b*. Each groove 145 extends the length of tracks 100 and opens facing inwardly toward mast 16 and angle 139. Lip 136 is generally parallel to bed 14. On either side of lip 136 within each groove 145 is a layer 140 of lubricating material which lines the walls of groove 145. This layer may be composed of nylon or the like.

Since lip 136 extends along the entire length of leg 18, mast 16 is provided with sufficient strength and stability to handle heavy containers. The use of two chains 108 ensures that the movement of mast 16 is smooth and even without skewing thereof. The positioning of grooves 145 so that they face inwardly and the use of a lubricating layer helps protect rails 100*a* and 100*b* from damage due to introduction of undesirable materials.

As shown in FIG. 8, located at end 112 of bed 14 and the end adjacent cab 12 are flippers 142 which are engageable by angles 139 as mast 16 reaches the end of tracks 100 where the respective flippers 142 are positioned. When these flippers are engaged, electric limit switches 144 are tripped which automatically stop the advance of mast 16 any farther towards that particular end of tracks 100.

All controls 122 for hydraulic cylinder 30, hydraulic cylinder 36, chains 108 and hydraulic cylinder 60, and limit switches 144 are located in cab 12 in a position easily accessible by a driver thereof. The precise positioning of the controls and their design is unimportant and may be accomplished in any manner known to those skilled in the art.

The operation of this invention will now be described with reference to FIGS. 1–6. When it is desired to lift a container 64 resting on the ground as shown in FIG. 3, the cab 12 and associated truck bed 14 are backed into a position in front of container 64. Fork lift assembly 40 is lowered by retracting hydraulic cylinder 30 until fork arms 50 and 52 are at the same level as sleeves 51 on container 64. The attitude of fork lift member 40 is adjusted by means of hydraulic cylinder 36 until arms 50 and 52 are level with sleeves 51. Mast 16 is then moved from right to left on bed 14 towards container 64 until fork arms 50 and 52 extend through sleeves 62 in a position shown in FIG. 3. Hydraulic cylinder 30 is then extended, raising boom 24 as shown in FIG. 2 until container 64 is above the level of bed 14. Thereafter, or simultaneously therewith, by activating chains 108, mast 16 is moved laterally along the truck bed 14 from left to right as shown in FIG. 2 until mast 16 is adjacent cab 12, as shown in FIG. 1. Once container 64 is located directly over bed 14, it is lowered by retracting hydraulic cylinder 30 until container 64 rests directly on bed 14 in the position shown in FIG. 1. Boom 30 is retracted some more until fork arms 50 and 52 press downwardly against the bottom of sleeves 62 to press container 64 against bed 14 to prevent sliding thereof during transportation. Raised edge 110 disposed along end 112 of bed 14 prevents container 64 from sliding off the end thereof.

During the above operation or shortly thereafter, cylinders 60 are retracted, and hatch cover clamps 54 are actuated. When this happens, arms 56 are lowered from an upwardly pointing position to a downwardly pointing position, and fingers 58 are clamped down onto the top of hatch 66 of container 64. Hatch 66 is thereby retained in a closed position and prevented from blowing open during movement of the vehicle. The container is now ready for transporting. Once the container is at the new site, the above process is reversed and the container is placed on the ground as shown in FIG. 3.

Although this invention has been described with reference to containers which are lifted by the insertion of fork arms into laterally disposed sleeves, this invention may be easily modified for use with rear loader containers and A-frame containers. For reference purposes, examples of the dimensions of a single-pole switch of this invention are set forth. It is to be understood that by providing such examples, the scope of the invention is in no way limited.

In its preferred configuration, the truck bed 14 is preferably 11 feet (3.36 m) long and 3 feet (0.92 m) above the ground. Mast 16 is preferably 4.5 feet (1.37 m) high, while boom 24 is preferably 5.5 feet (1.68 m) long. Fork arms 50 and 52 are preferably 4 feet (1.22 m) long, while vertical arms 44 and 46 are preferably 4 feet (1.22 m) high. Arm 34 is preferably 22 inches (0.56 m) long, while linkage 32 is preferably 40 inches (1.02 m) long. Hydraulic cylinders 30, 36 and 60 may be of any size and configuration sufficient to perform the tasks described and the operation thereof is well-known to those skilled in the art. Fork arms 50 and 52 are preferably spaced sufficiently far apart to accommodate standard containers 64, while fork arms 50 and 52 are sufficiently long to extend all the way through sleeves 51 found on such containers.

With respect to materials, most of the above-described components are preferably composed of steel, except the mast which is formed of high tensile steel.

In view of the above description, it is likely that modifications and improvements will occur to those skilled in the art which are within the scope of this invention.

What is claimed is:

1. A container-handling vehicle comprising:

a vehicular bed supported substantially in a horizontal position and extending longitudinally between a front end and a rear end and transversely between two sides thereof;

a single mast disposed on said bed generally in the transverse center thereof and extending generally vertically from said bed, said mast being horizontally slidable in a longitudinal direction on said bed from said front end to said rear end;

a boom extending from said mast towards said rear end of said bed;

means for raising and lowering said boom;

a fork lift assembly mounted onto the distal end of said boom and having arms adapted for grasping a container for raising and lowering thereof and for placing said container on said vehicular bed;

means adapted for maintaining said fork lift assembly at a predetermined attitude during raising and lowering of said container and during placement of said container on said vehicular bed; and means adapted for moving said mast longitudinally along said vehicular bed selectively in both directions between said rear end and said front end to permit said container to be lifted over said rear end and onto said vehicular bed at said rear end and to permit said container to be subsequently lifted from said vehicular bed.

2. The container-handling vehicle of claim 1 further comprising hatch clamp means secured to said fork lift assembly independently of said container and adapted to be urged against hatches on said container to maintain the hatches in a closed position while said container is being grasped by said fork lift assembly.

3. The container-handling vehicle of claim 2 wherein said hatch clamp means comprises:

at least one clamp arm having an end pivotally secured to said fork lift assembly;

a projection disposed on the distal end of each of said clamp arms and extending perpendicularly from said clamp arm; and hydraulically-actuated means adapted to selectively pivot each of said clamp arms into an operating position in which said projection is in engagement with a hatch cover on said container, and into a non-operating position in which said projection is not in engagement with a hatch cover.

4. The container-handling vehicle of claim 1 or 2 further comprising means for pivoting said fork lift assembly into a desired attitude with respect to said vehicular bed.

5. The container-handling vehicle of claim 1 or 2 wherein said means for moving said mast comprises at least one chain extending from said front end to said rear end, said chain being secured to said mast.

6. The container-handling vehicle of claim 5 wherein said means for moving said mast further comprises:

motor means;

a second chain disposed parallel to said one chain and extending from said front end to said rear end;

a front axle rotatable by said motor means and disposed adjacent said front end;

a rear axle disposed adjacent said rear end;

front gear means coupling said front axle to said one chain and to said second chain;

rear gear means coupling said rear axle to said one chain and to said second chain;

means coupling said mast to said one chain and to said second chain; and a pair of tracks in sliding engagement with said mast and adapted to support said mast, said tracks extending from said front end to said rear end.

7. The container-handling vehicle of claim 6 wherein said means for moving said mast further comprises limit switch means disposed at said front end and at said rear end, said limit switch means being adapted to disengage said front axle from said motor means to stop rotation of said front axle when said mast reaches a position at a predetermined distance from said rear end and a position at a predetermined distance from said front end.

8. The container-handling vehicle of claim 6 wherein each of said tracks has a groove extending along the length thereof and facing the groove disposed in the other of said tracks, and wherein said mast includes a pair of lips projecting therefrom and extending longitudinally therealong, each of said lips being slidably disposed in one of said grooves.

9. The container-handling vehicle of claim 8 wherein said grooves are lined with a lubricating material disposed on either side of said lip.

10. The container-handling vehicle of claim 1 wherein said maintaining means comprises:

a vertical leg disposed substantially perpendicularly of said fork lift assembly arms and parallel to support members of said fork lift assembly;

an inner mechanical linkage interconnecting said leg and said mast;

an outer mechanical linkage interconnecting said support members of said fork lift assembly and said leg.

11. The container-handling vehicle of claim 1 wherein said boom comprises a first linear section secured at one end thereof to said mast and a second linear section secured at one end thereof to said fork lift assembly, said first section and said second section being joined together at another end thereof by an obtuse angle.

12. The container-handling vehicle of claim 1 wherein said second section of said boom is substantially perpendicular of said fork lift assembly arms when said fork lift assembly arms are disposed at a predetermined distance below said vehicular bed.

13. The container-handling vehicle of claim 11 or 12 wherein said hydraulically-actuated means is secured to said first section of said boom.

14. A container-handling vehicle comprising:

a vehicular bed supported substantially in a horizontal position and having a front end and a rear end;

a mast disposed on said bed and extending generally vertically from said bed, said mast being horizontally slidable on said bed from said front end to said rear end;

a boom extending from said mast towards said rear end of said bed;

means for raising and lowering said boom;

a fork lift assembly mounted onto the distal end of said boom and having arms adapted for grasping a container for raising and lowering thereof;

means adapted for maintaining said fork lift assembly at a predetermined attitude during raising and lowering of said container;

means adapted for moving said mast longitudinally along said vehicular bed selectively in both directions between said rear end and said front end to permit said container to be lifted onto said vehicular bed at said rear end and to permit said container to be subsequently lifted from said vehicular bed; and hatch clamp means disposed on said fork lift assembly and adapted to be clamped against hatches on said container to maintain the hatches in a closed position during transportation of said container, said hatch clamp means comprising:

at least one clamp arm having an end pivotally secured to said fork lift assembly;

a projection disposed on the distal end of each of said clamp arms and extending perpendicularly therefrom; and hydraulically-actuated means adapted to selectively pivot each of said clamp arms into an operating position in which said projection is in engagement with a hatch cover on said container, and into a non-operating position in which said projection is not in engagement with a hatch cover.

15. A container-handling vehicle comprising:

a vehicular bed supported substantially in a horizontal position and having a front end and a rear end;

a mast disposed on said bed and extending generally vertically from said bed, said mast being horizontally slidable on said bed from said front end to said rear end;

a boom extending from said mast towards said rear end of said bed;

means for raising and lowering said boom;

a fork lift assembly mounted onto the distal end of said boom and having arms adapted for grasping a container for raising and lowering thereof;

means adapted for moving said mast longitudinally along said vehicular bed selectively in both directions between said rear end and said front end to permit said container to be lifted onto said vehicular bed at said rear end and to permit said container to be subsequently lifted from said vehicular bed;

means for pivoting said fork lift assembly into a desired attitude with respect to said vehicular bed; and means adapted for maintaining said fork lift assembly at a predetermined attitude during raising and lowering of a container, said maintaining means comprising:

a vertical leg disposed substantially perpendicularly of said fork lift assembly arms and parallel to support members of said fork lift assembly;

an inner mechanical linkage interconnecting said leg and said mast; and an outer mechanical linkage interconnecting said support members of said fork lift and said leg.

16. The container-handling vehicle of claim 10 or 15 wherein at least one of said inner and outer mechanical linkages forms a parallelogram linkage.

17. The container-handling vehicle of claim 15 wherein said pivoting means comprises one element of said inner mechanical linkage.

18. The container-handling vehicle of claim 15 or 17 wherein said pivoting means comprises a hydraulically-actuated arm secured to said vertical leg between the ends thereof, said hydraulically-actuated arm being operable to pivot said vertical leg about one end thereof.

19. The container-handling vehicle of claim 14 or 15 wherein said fork lift assembly comprises two of said arms, said fork lift assembly arms being spaced from and generally parallel to one another and adapted for insertion into sleeves on said container.

* * * * *